US008424728B2

(12) United States Patent
Dubach

(10) Patent No.: US 8,424,728 B2
(45) Date of Patent: Apr. 23, 2013

(54) PLASTIC CLOSURE FOR THIXOTROPIC DISPENSING BOTTLES

(75) Inventor: Werner Dubach, Maur (CH)

(73) Assignee: Deltona Innovations AG, Maur (CH)

( * ) Notice: Subject to any disclaimer, the term of this patent is extended or adjusted under 35 U.S.C. 154(b) by 249 days.

(21) Appl. No.: 12/734,122

(22) PCT Filed: Sep. 26, 2008

(86) PCT No.: PCT/CH2008/000402

§ 371 (c)(1),
(2), (4) Date: Sep. 2, 2010

(87) PCT Pub. No.: WO2009/046553

PCT Pub. Date: Apr. 16, 2009

(65) Prior Publication Data

US 2011/0000870 A1 Jan. 6, 2011

(30) Foreign Application Priority Data

Oct. 10, 2007 (CH) ..... 1568/07
Sep. 22, 2008 (CH) ..... 1490/08

(51) Int. Cl.
*B67D 3/00* (2006.01)

(52) U.S. Cl.
USPC ..... 222/482; 215/307; 220/374; 222/212; 222/546; 222/547

(58) Field of Classification Search ..... 215/307; 220/374; 222/212, 482, 544–547, 571
See application file for complete search history.

(56) References Cited

U.S. PATENT DOCUMENTS

| | | | | |
|---|---|---|---|---|
| 2,175,052 | A | 10/1939 | Bull et al. | |
| 3,134,517 | A * | 5/1964 | Seybold | 222/319 |
| 4,460,101 | A | 7/1984 | Tseng | |
| 4,785,978 | A * | 11/1988 | Kano et al. | 222/482 |
| 5,651,471 | A * | 7/1997 | Green | 220/231 |
| 6,832,706 | B2 * | 12/2004 | Hearld et al. | 222/494 |
| 7,255,250 | B2 * | 8/2007 | Pugne | 222/556 |
| 2004/0245290 | A1 * | 12/2004 | Hagihara | 222/207 |
| 2005/0087571 | A1 * | 4/2005 | Dark | 222/544 |
| 2010/0072231 | A1 * | 3/2010 | Bloom et al. | 222/547 |
| 2010/0320235 | A1 * | 12/2010 | Dubach | 222/212 |
| 2011/0290824 | A1 * | 12/2011 | Smith et al. | 222/135 |

FOREIGN PATENT DOCUMENTS

| | | | |
|---|---|---|---|
| DE | 201 12 974 | U1 | 9/2002 |
| EP | 0 442 379 | A2 | 8/1991 |
| EP | 0 545 678 | A2 | 6/1993 |
| WO | WO 2006/119315 | A2 | 11/2006 |

* cited by examiner

*Primary Examiner* — Kevin P Shaver
*Assistant Examiner* — Patrick M Buechner
(74) *Attorney, Agent, or Firm* — Pauley Petersen & Erickson

(57) ABSTRACT

A plastic closure including a bottom part and a lid that has an annular retaining bead in the bottom part. A disk having a support surface is held positively or non-positively in the bead. The disk includes one or more through-passages, which open into a chamber. A thixotropic fluid present in a flexible container reaches the chamber through the through-passages, where the fluid performs a directional change from axial to radial and after a second directional change from radial to axial flows out through the spout opening, wherein a constriction between the two directional changes accelerates the flow.

8 Claims, 2 Drawing Sheets

PLASTIC CLOSURE FOR THIXOTROPIC DISPENSING BOTTLES

BACKGROUND OF THE INVENTION

1. Field of the Invention

This invention relates to a two-part or multipart plastic closure for fastening to the neck of a flexible bottle for dispensing thixotropic fluids.

2. Discussion of Related Art

Thixotropic fluids are fluids with a non-Newtonian flow behavior. A typical example of such a fluid is ketchup. Various liquid soaps also exhibit thixotropic behavior, as do many dispersions. Today, such fluids are sold in flexible plastic containers having closures equipped with a so-called closure membrane. There are many known embodiments of closures equipped with a so-called closure membrane. Examples include those taught by European Patent References EP-A-545 678 and EP-A-442 379, U.S. Pat. No. 2,175,052, or PCT International Application WO-A-2006/119315. The significant advantage of closures having a closure membrane is that the already open container can be stood on its head without the fluid leaking out of it. Pressure exerted on the flexible bottle deforms the closure membrane, the usually slit-shaped opening spreads open, and the fluid can be squeezed out of the bottle. In this case, one problem arises because as the more tautly the membrane is held, the better the closing force is and the quicker the closure closes when the pressure on the container is released. As a result, an ever more powerful vacuum builds up in the container over time so that the bottle becomes more and more deformed as its contents are consumed and also the pressure required to dispense the fluid must be increased. If the closure membrane is stretched less tautly, then at least sometimes, a certain amount of the displaced air can flow back into the container; as a result of this, the closure also tends to drip. Furthermore, the more tautly the closure membrane is stretched, the more the closure tends to open explosively when pressure is exerted, causing a jet to emerge at high velocity and the container to have a tendency to spray.

In order to reduce this problem, a variety of complex closure membrane closures are marketed for which the design of the closure membrane has become more and more complex and the very small component requires more and more effort with regard to its installation in the closure. With these complex closure membranes, it is possible to produce a closing action and an opening of the slit-shaped closure as soon as a pressure difference exists between the atmosphere and the internal pressure of the bottle, which assures the venting of plastic bottles. But merely due to the variety of materials that must be used in these plastic bottles with closure membranes, namely the membrane must usually be made of a silicone rubber and the actual closure also must be produced from a polypropylene because it is not possible to produce them in one injection procedure in the same machine. Also, the silicone rubber part is a relatively expensive part and for this reason alone, it is desirable for it to be as small as possible. When this part is small, however, and is at the same time highly flexible, its installation by machine is extremely complex and malfunction-prone.

Development of the closure according to this invention provides a closure that is limited to the use of thixotropic fluids. Thixotropy is understood to be the property of a non-Newtonian fluid in which the viscosity decreases in response to constant shear stress over a certain period of time. After the shear stress stops, the initial viscosity is reestablished. In other words, the longer a thixotropic fluid is moved, the lower its viscosity becomes. It is normally true that the faster the movement is carried out, the faster the viscosity decreases. In other words, in such a closure, the flow-through direction is changed and the flow is accelerated, thus achieving a good flow capacity of the thixotropic fluid while at the same time, a simple shut-off in the flow direction can prevent leakage at a lower viscosity.

German Patent Reference DE-U-20112974 discloses a plastic closure in which an inner cap with two concentric walls can be inserted underneath the pouring spout and in the assembled state, the pouring spout protrudes into the region of the inner concentric wall. This produces an outflow labyrinth with a siphon effect intended to empty the siphon through suction as the flexible bottle returns to its original shape. The very complex outflow path with a multitude of direction changes and a plurality of constrictions with thixotropic fluids causes the interior friction to produce a high resistance that must be overcome upon actuation and results in an abrupt outflow of fluid upon actuation. At the same time, such a labyrinth is also inevitably accompanied by a certain amount of residues that remain behind and dry out due to the inclusion of air inside the labyrinth path. These residues constrict the flow path, thus further exacerbating the above-described problems. It is known that closures of this kind become completely clogged over time and as a result, such closures are no longer on the market today.

U.S. Pat. No. 4,460,101 discloses such a labyrinth closure, with a support surface mounted underneath the spout. This closure has the above-described problems where the flow path is even more complex, resulting in this closure having an even greater tendency to become clogged. In particular, the latter patent mentions the use of thixotropic fluids. With the many direction changes and constrictions, the viscosity of the fluid is necessarily improved by the internal friction, but as mentioned above, the flow path is so complex that the function is only assured to a tolerable degree if the container is shaken vigorously beforehand, thus reducing the thixotropy and already changing the viscosity. Thus for practical purposes, the additional direction changes and constrictions are hardly needed anymore. Through corresponding testing, the applicant has simplified the closure according to this invention on the basis of the known prior art so that the problems mentioned no longer occur. With only one constriction and only two direction changes, it is possible to sufficiently reduce the thixotropy while at the same time, reducing the exerted force and leaving hardly any possibility for the closure to become sticky or clogged over long-term use. Despite the problem that has existed for years with closures of this kind, up until now, the market has not seen the introduction of any closures that are especially suited for thixotropic fluids and that do not become clogged, even with longer term use.

SUMMARY OF THE INVENTION

One embodiment of a closure that makes simple use of the flow behavior of thixotropic fluids is based on embodiments disclosed in this specification and in the claims.

BRIEF DESCRIPTION OF THE DRAWINGS

Two embodiments of this invention are shown in the drawings and explained in view of the following description taken in conjunction with the drawings, wherein.

DETAILED DESCRIPTION OF THE INVENTION

Figure 2:
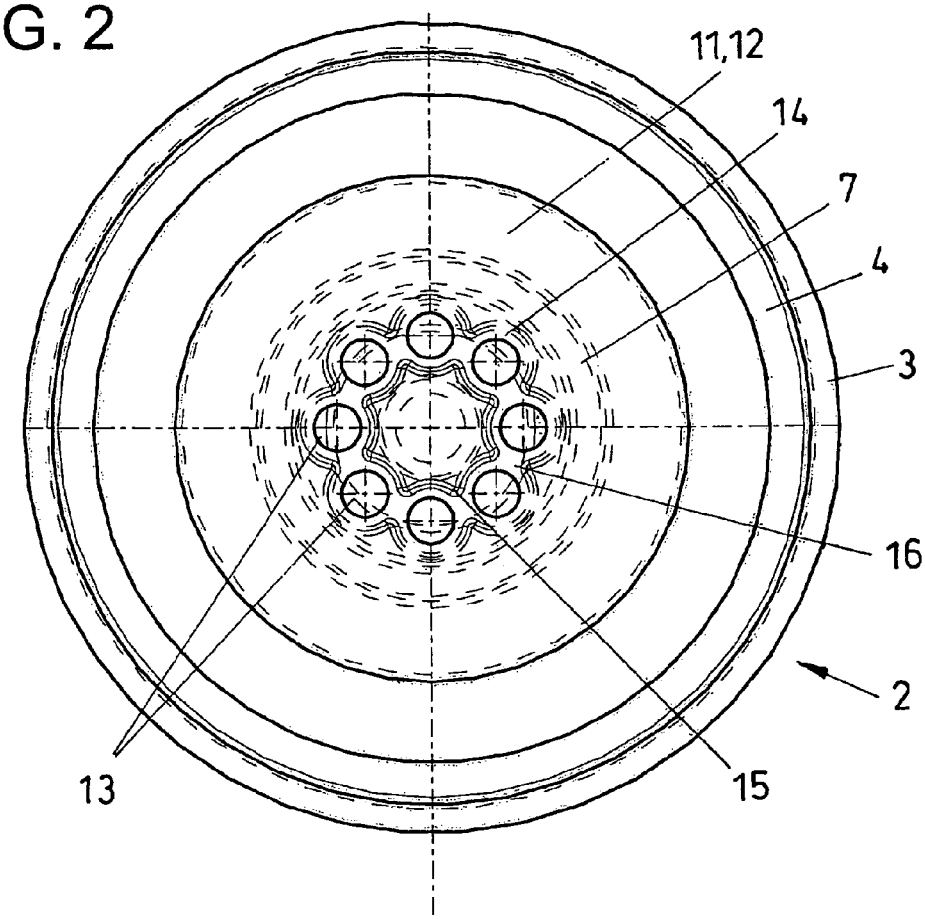
FIG. 2 shows the same bottom part according to FIG. 1, in a bottom view.
Figure 1:
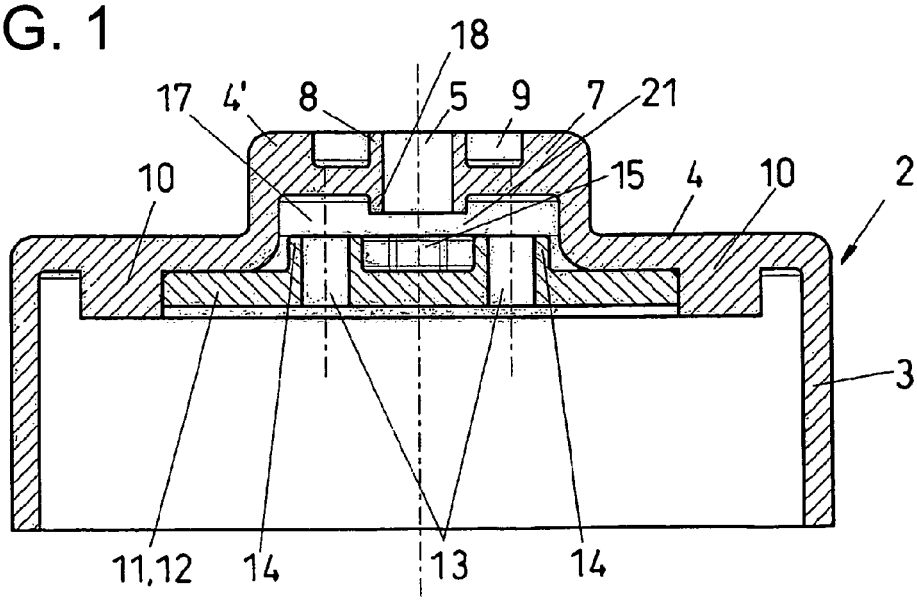
FIG. 1 shows a diametrical, vertical section taken through the bottom part of a plastic closure according to a first embodiment of this invention.
Figure 4:
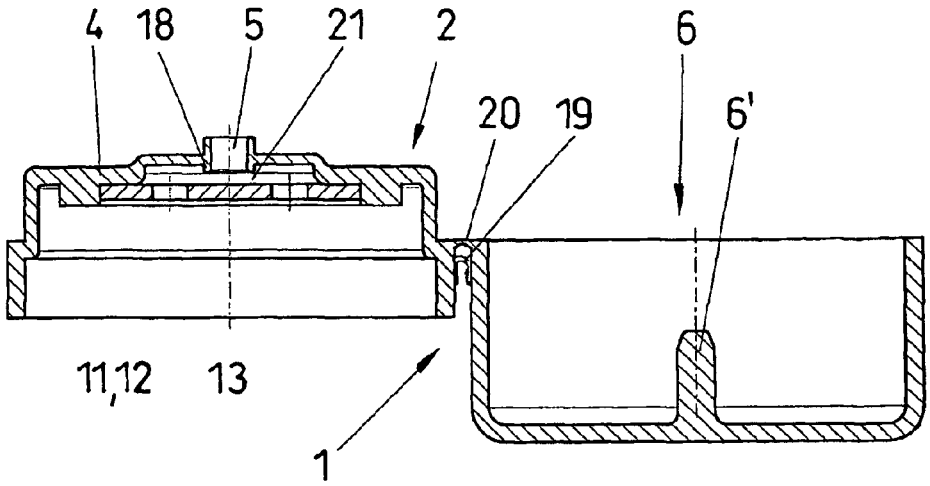
FIG. 4 shows a closure according to FIG. 1, equipped with a snapping hinged cover.

The plastic closure according to this invention is labeled as a whole with the reference numeral 1. This plastic closure comprises a bottom part 2 and a top part or cover 6. The plastic closure 1 can comprise two parts or multiple parts. In this context, a "two-part closure" is understood to relate to a closure in which the bottom part and the cover are produced of one piece and the as yet undescribed support surface is a separate disk. But if the bottom part and cover are produced separately and the above-mentioned disk is also provided, then this is referred to as a "multipart plastic closure". FIGS. 1 and 2 show a multipart plastic closure, while FIG. 4 shows a two-part plastic closure in which the bottom part 2 and the cover 3 are produced of one piece.

The bottom part 2 contains parts that are essential to this invention and the bottom part 2 can have practically any shape or embodiment, as known from plastic closures according to the prior art. Correspondingly, the bottom part 2 is shown only in a symbolic, simplified fashion. The bottom parts are shown here without the features that are intrinsically required but, nonessential with regard to an embodiment of this invention. For example, the bottom part 2 has a fastener for fastening the plastic closure 1 to a container. As shown in the drawings, the fastener can be embodied in the form of threads, but there are also other possible fasteners such as retaining beads or retaining cams. Such plastic closures can also have tamper-evident bands.

One particularly simple embodiment of this invention is shown in FIGS. 1 and 2. As mentioned above, these drawings show only a simplified embodiment of the bottom part 2. As mentioned above, they are shown without the fastener for fastening the bottom part 2 to the container neck and without the means with which a cover, not shown here, is to be fastened or affixed to the bottom part 2 and possibly, corresponding sealing means. The bottom part 2 has a surrounding circumferential wall 3 and its upper end is completely closed by a top surface 4, with the exception of a pouring opening 5. In the embodiment shown, the top surface 4 has a raised area 7. The raised area 7, which can be cylindrical as shown, contains one pouring opening 5 in the embodiment shown. An annular groove 9 around the pouring opening 5 is provided in the surface of the raised area 7 and forms a spout 8 that extends through the top surface 4' of the raised area 7 and has an extension 18 on the underside.

The top surface 4 has an annular retaining bead 10 formed onto its underside. The retaining bead 10 is larger in diameter than the diameter of the raised area 7. Between the annular retaining bead and the circumference wall 3, there is a gap into which a bottle neck comes to rest. The bottle neck can be sealed toward the outside by the circumference wall 3 while the inside of the bottle neck can be sealed either by the annular retaining bead 10 or, a separate annular wall for sealing can be provided between the annular retaining bead 10 and the circumference wall 3. The annular wall, not shown, would be situated concentric to the circumference wall 3. Other sealing means can be provided between this circumference wall or the annular retaining bead 10 and the top surface 4.

A disk 11 that constitutes or forms a support surface 12 is inserted into the region defined by the annular retaining bead 10. The disk 11 or support surface 12 is secured in the annular bead 10 by form-locked and/or frictional, nonpositive engagement. The annular retaining bead 10 can with have additional means for improving the form-locked engagement. The means can be embodied, for example, in the form of annular retaining beads or a plurality of cams that are oriented toward the center and hold the disk 11 in the correct final position. The annular retaining bead 10 positions the disk 11 in the axial direction. An alignment in the radial direction is not required.

The disk 11 has a plurality of through openings 13. If the disk 11 is a circular disk, then for logical reasons, the through openings 13 are arranged in a circle. The through openings 13 are offset enough radially so that they are situated outside the region of the inner diameter of the exit opening 5. The through openings 13 are also extended in a spout-like fashion up toward the raised area 7. The extensions 14, however, end beneath the extension 18 of the spout 8 of the pouring opening 5 in the raised area 7. The spout-like extensions 14 form a kind of central raised area on the disk 11. At the same time, a central recess 15 remains which is achieved if the spout-like extensions 14 touch one another and transition into one another and thus, for all practical purposes, constitute or form a star-shaped annular wall 16. The central recess 14 formed by the star-shaped annular wall 16 is situated directly beneath the pouring opening 5. A chamber 17 remains between the top surface of the disk 11 that constitutes or forms the support surface 12 and the underside of the top surface 4' of the raised area 7. If no raised area 7 is provided in the top surface 4, the chamber 17 can also be formed by having the annular retaining bead extend further downward in the axial direction and having the support surface 12 or the disk 11 be secured in a position further down. In any case, the presence of the chamber 17 is assured.

The disk 11 is referred to as the support surface 12 because the static hydraulic pressure of the non-Newtonian fluid rests against it when the bottle onto which the plastic closure is placed is standing on its head. Even if the pouring opening 5 is not closed, the thixotropic fluid cannot flow out. But if a pressure is exerted on the flexible bottle, then the thixotropic fluid flows through the through openings 13 into the chamber 17 in the axial direction, which causes a first direction change of the flow from the axial direction to the radial direction. The chamber 17 is filled and the thixotropic fluid moves radially toward the center and upon an additional direction change, the thixotropic fluid exits through the pouring opening 5. During this flow movement, shearing forces occur in the fluid, which cause the thixotropic fluid to become less viscous, thus improving its flow behavior.

Between the two direction changes during the flow from the bottle into the chamber 18 and during the flow out of the chamber 18 between the disk 11 and the top surface 4 or the raised top surface 4', there is precisely one constriction 21 that produces an increase in the flow speed.

This constriction could be produced by an annular aperture. In the present case, however, the constriction is embodied in a preferable, particularly simple form if the extensions 14 and 18 of the spouts 13 in the disk 11 and the spout 8 of the pouring opening extend toward one another. In this case, the spout edges can only approach one another, but the free radial passage must remain open.

As soon as the pressure on the flexible bottle is released, then as the flexible bottle returns to its original shape, a vacuum builds up in the bottle, the outflow jet stops abruptly, and the fluid contained in the spout 8 is sucked or drawn back into the chamber 17 and sucked or drawn back into the bottle via the through openings 13 with the spout-like extensions 14. The cross-sectional constrictions cause a Bernoulli effect to occur both in the pouring opening and in the through openings 13 and correspondingly, the chamber 17 is emptied according to the Venturi principle. Tests have shown that this first embodiment of this invention permits an absolutely drip-free flow, the jet stops immediately after the pressure on the bottle stops, and for all practical purposes, a suction back into the pouring opening 5 is produced in the region close to the pouring opening. As a result, the mouth of the pouring opening remains absolutely clean. The Venturi principle also completely empties the chamber 17, consequently also preventing residues from drying in the chamber 17 and thus clogging the closure. This effect can only be achieved with a sufficient flow speed, which in turn can only be assured by avoiding the use of a labyrinth seal. Consequently, one object of this invention is completely attained by embodying a plastic closure that does not have a silicone rubber membrane, but does have all of the advantages of such a closure, with a significantly more reasonably priced, reliable implementation. In addition, the disk 11 functioning as a support surface 12 is a very simple plastic part that can be inexpensively produced and, by virtue of its strength, is also significantly easier to install than a membrane of silicone rubber. The cross-sectional area of the pouring opening can be smaller than the sum of the cross-sectional areas of the through openings 13.

Figure 3:
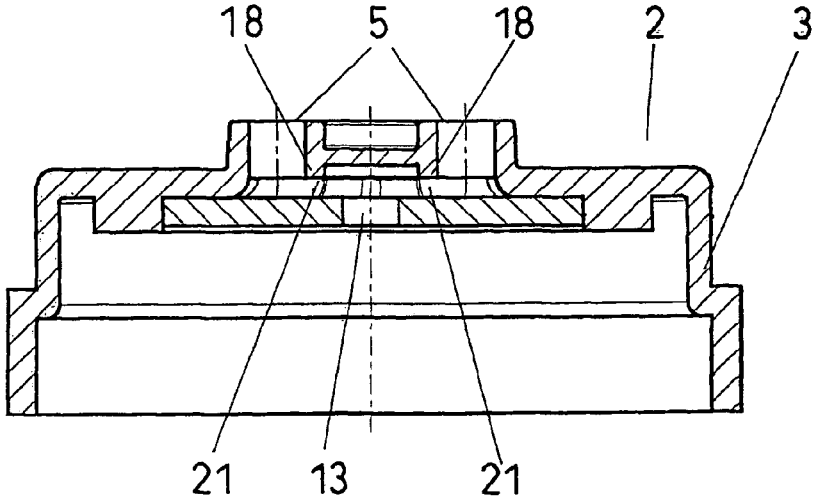
FIG. 3 shows one embodiment with a plurality of pouring openings.

FIG. 3 shows an additional embodiment. By contrast with the embodiment described above, in this case, the disk 11 has only one central through opening that is labeled with the reference numeral 13'. This through opening 13' can also have a spout-shaped extension 14. Also, the top surface 4 can have a raised area with a corresponding top surface 4'. By contrast with the above-described embodiment, the top surface 4' contains a multitude of pouring spouts 8'. At least two pouring spouts 8' situated approximately diametrically opposite each other can be provided. However, any number of these spouts can be arranged in a circle. The central recess 21 in the top surface 4' of the raised area essentially serves to form a spout. This chamber can, however, also be embodied as filled with material.

Finally, merely for the sake of completeness, FIG. 4 shows a two-part closure mentioned at the beginning. In this case, the bottom part 2 and the cover 6 are connected to each other by a film hinge 20 and tautening bands 19 so that the closure as a whole constitutes or forms a snapping hinged closure. The top 6 has a sealing pin 6' formed into it, which can engage in the pouring spout 8, thus producing a largely hermetic seal.

The invention claimed is:

1. A two-part or multipart plastic closure (1) for fastening to a neck of a flexible bottle for dispensing thixotropic fluids, comprising a bottom part (2) with a circumference wall (3) and a top surface (4) into which at least one pouring opening (5) is formed; below the top surface (4) and spaced apart from the top surface (4) in an axial direction, a support surface (12) closes off a free axial passage from a container neck to the at least one pouring opening (5); the support surface (12) having at least one axially extending through opening (13), which is radially offset in relation to the at least one pouring opening (5); an underside of the top surface (4) having a formed-on annular retaining bead (10) or a retaining wall in which a separate disk (11) serving as the support surface (12) is secured by a form-locked and/or frictional nonpositive engagement; in a chamber (17) between the support surface (12) and the top surface (4) in both flow directions only one direction change from axial to radial and one subsequent direction change from radial to axial occurring and between the two direction changes a flow constriction (21) provided wherein the disk (11) has a central raised area smaller in diameter than a raised area (7) in the top surface (4) of the bottom part (2) and the central raised area of the disk having a central recess (15) around which the at least one axially extending through opening (13) in the central raised area is arranged and having a spout-shaped extension (14) extending into a region close to a level of the lower edge of the extension of the at least one pouring opening (5) to produce a flow passage free in a radial direction, but having a constriction (21).

2. The plastic closure as recited in claim 1, wherein a sum of cross-sectional areas of the axially extending through openings (13) is greater than or equal to a cross-sectional area of the at least one pouring opening (5).

3. The plastic closure as recited in claim 1, wherein the top surface (4) has the raised area (7) in which the at least one pouring opening (5) is situated in a form of a spout (8).

4. The plastic closure as recited in claim 3, wherein the support surface (12) is situated beneath the raised area (7).

5. The plastic closure as recited in claim 1, wherein the axial through openings (13) are situated in at least one circle that is concentric to the at least one pouring opening (5) and having a diameter large enough for the axial through openings (13) to be situated completely outside a region of the at least one pouring opening (5).

6. The plastic closure as recited in claim 1, wherein the at least one pouring opening (5) is formed by a spout (8) formed into the raised area (7) and extending toward the disk (11) by an extension (18) reaching below the top surface (4') covering the raised area (7) and thus constitutes the flow constriction (21).

7. The plastic closure as recited in claim 3, wherein an annular groove (9) extends around the at least one pouring opening (5) in the top surface (4') of the raised area (7).

8. The plastic closure as recited in claim 1, wherein only one through opening (13) is provided in the separate disk (11) and a plurality of pouring openings (5) are radially offset from the through opening (13).

* * * * *